US010273038B2

(12) United States Patent
Diminick et al.

(10) Patent No.: US 10,273,038 B2
(45) Date of Patent: Apr. 30, 2019

(54) OVERPACK DRUMS

(71) Applicant: New Pig Corporation, Tipton, PA (US)

(72) Inventors: Anthony Scott Diminick, Hollidaysburg, PA (US); R. Douglas Evans, Jr., Everett, PA (US); Robert J. Starr, Tyrone, PA (US)

(73) Assignee: New Pig Corporation, Tipton, PA (US)

( * ) Notice: Subject to any disclaimer, the term of this patent is extended or adjusted under 35 U.S.C. 154(b) by 41 days.

(21) Appl. No.: 14/862,686

(22) Filed: Sep. 23, 2015

(65) Prior Publication Data

US 2016/0083150 A1 Mar. 24, 2016

Related U.S. Application Data

(60) Provisional application No. 62/054,015, filed on Sep. 23, 2014.

(51) Int. Cl.
*B65D 1/40* (2006.01)
*B65D 43/02* (2006.01)

(52) U.S. Cl.
CPC ..... *B65D 1/40* (2013.01); *B65D 43/0231* (2013.01); *B65D 2543/005* (2013.01); *B65D 2543/00027* (2013.01); *B65D 2543/00092* (2013.01); *B65D 2543/00296* (2013.01); *B65D 2543/00407* (2013.01); *B65D 2543/00416* (2013.01); *B65D 2543/00842* (2013.01)

(58) Field of Classification Search
CPC ..... B65D 1/40; B65D 2543/00027; B65D 2543/00092; B65D 2543/00296; B65D 2543/00407; B65D 2543/005; B65D 2543/00842; B65D 43/0231; B65D 1/243; B65D 41/0485; B65D 51/243
USPC ..... 220/260, 274, 284, 285, 288, 315, 669, 220/608, 628, 630; 215/295, 302; 81/3.36
See application file for complete search history.

(56) References Cited

U.S. PATENT DOCUMENTS

| | | | | |
|---|---|---|---|---|
| 146,824 | A * | 1/1874 | Hale et al. | B65D 41/0485 215/302 |
| 4,190,169 | A | 2/1980 | Pehr | |
| 4,401,227 | A | 8/1983 | Pehr | |
| 4,708,258 | A | 11/1987 | Shaw et al. | |
| 4,934,547 | A * | 6/1990 | Mayes | A61B 10/007 215/250 |
| D309,364 | S | 7/1990 | Shaw et al. | |
| 5,042,683 | A | 8/1991 | Shaw et al. | |

(Continued)

OTHER PUBLICATIONS

PIGALOG Catalog, New Pig Corp., 2013 (3 pp).

*Primary Examiner* — James N Smalley
*Assistant Examiner* — Madison L Poos
(74) *Attorney, Agent, or Firm* — Alan G. Towner, Esq.; Leech Tishman Fuscaldo & Lampl

(57) ABSTRACT

Overpack drum assemblies are disclosed. The overpack drum assemblies include a container base and a lid that may be securely closed on the base within a range of acceptable closure positions that may be visually indicated. The lid may include at least one leverage bracket for receiving a bar or other leverage tool that facilitates tightening and loosening of the lid. The container base may include at least one indented anti-rotation notch to help secure the container base against rotation during tightening or loosening of the lid. An anti-rotation fixture may be used to resist rotation of the container base.

7 Claims, 6 Drawing Sheets

(56) References Cited

U.S. PATENT DOCUMENTS

| | | | | |
|---|---|---|---|---|
| 5,096,083 | A | 3/1992 | Shaw et al. | |
| 5,150,804 | A * | 9/1992 | Blanchet | B65D 21/0223 206/505 |
| 5,373,958 | A | 12/1994 | Bokmiller | |
| 5,560,510 | A | 10/1996 | Grebenyuk et al. | |
| 5,605,244 | A | 2/1997 | Bradshaw | |
| 5,875,915 | A | 2/1999 | Bradshaw et al. | |
| 8,281,948 | B2 | 10/2012 | Stanek et al. | |
| 8,528,772 | B1 * | 9/2013 | Morris, Jr. | B65D 45/16 206/506 |
| 2008/0210577 | A1 * | 9/2008 | Van Handel | B65D 41/0485 215/302 |
| 2010/0288667 | A1 * | 11/2010 | Stanek | B65D 43/0231 206/459.1 |
| 2012/0324832 | A1 | 12/2012 | Stanek et al. | |

* cited by examiner

OVERPACK DRUMS

CROSS-REFERENCE TO RELATED APPLICATION

This application claims the benefit of U.S. Provisional Patent Application Ser. No. 62/054,015 filed Sep. 23, 2014, which is incorporated herein by reference.

FIELD OF THE INVENTION

The present invention relates to overpack drum assemblies including a container base and a lid that may be tightened securely to the base.

BACKGROUND INFORMATION

The U.S. Department of Transportation ("USDOT") has established regulations for removable head salvage drums, e.g., 49 CFR § 1.173(c), which are also known in the art as overpack salvage drums. Overpack salvage drums are used in a variety of applications, including for the containment of packages that have been damaged, have otherwise become defective, or have been found to be leaking and/or for the containment of potentially hazardous solid materials while they are being transported.

SUMMARY OF THE INVENTION

Overpack drum assemblies are provided. The overpack drum assemblies include a container base and a lid that may be securely closed on the base within a range of acceptable closure positions that may be visually indicated. The lid may include at least one leverage bracket for receiving a bar or other leverage tool that facilitates tightening of the lid. The container base may include at least one indented anti-rotation notch to help secure the container base against rotation during tightening or loosening of the lid. An anti-rotation fixture may be used to resist rotation of the container base.

Certain embodiments of the present invention provide a closure zone indicator that indicates proper sealing and closure of containers to ensure that potential hazardous contents are secured for safe transportation. For example, to visually indicate that an overpack drum is properly closed, a visual indicator on a lid may be aligned within a closure zone on the container base, such as a group of holes and accompanying tabs on a radially extending rim that encircles the drum base. A user may thread the lid completely onto the base and then exert further force until the indicator is within the base tabs. Such alignment indicates a properly closed container and will be considered safe for transportation, e.g., as long as the contents fall within the specified container ratings.

Overpack drums are often used as part of spill kits that contain absorbent materials and other items for responding to liquid spills. Such liquid spill kits are important parts of spill response contingency plans. Ensuring that the spill response contents of those kits are there when needed becomes critical. In the past, the contents of unsecured kits have sometimes been pilfered and used for non-spill response events. Those used contents are sometimes not refilled, leaving the kit unprepared for a true emergency event. Tamper evident features of the present invention allow such kits to be secured with a security device such as a tamper tag. In the event someone uses the kit, the security device must be removed to access the contents of the kit and cannot be reattached. The absence or damage of a security device provides visual evidence that the kit has been opened and requires an inspection to ensure readiness. A new security device can be attached to indicate a new state of readiness.

An aspect of the present invention is to provide an overpack drum lid comprising a generally circular top surface, a lower rim, a generally cylindrical threaded sidewall extending between the top surface and the lower rim, and a pair of opposing leverage brackets circumferentially spaced from each other on the lid extending upward from the top surface, wherein each leverage bracket comprises an at least partially enclosed leverage hole structured and arranged to receive a leverage bar therethrough.

Another aspect of the present invention is to provide an overpack drum container base comprising a bottom surface, an upper opening, a generally cylindrical sidewall extending between the bottom surface and the upper opening, and at least one anti-rotation notch adjacent the bottom surface extending radially inward from the sidewall a distance less than a radius of the sidewall.

A further aspect of the present invention is to provide an anti-rotation fixture for resisting rotational movement of an overpack drum container base when a lid is secured to or removed from the container base. The anti-rotation fixture comprises a base, and two anti-rotation pegs located adjacent to opposite edges of the base and extending upward from the base, wherein the anti-rotation pegs are structured and arranged to be at least partially received within anti-rotation notches in a bottom of the overpack drum container base.

Another aspect of the present invention is to provide an overpack drum assembly comprising a container base comprising an upper opening and a radially extending rim adjacent to the upper opening comprising a plurality of closure indicator tabs circumferentially spaced on a portion of the radially extending rim, and a lid threadingly engageable with the container base comprising at least one closure security hole rotatingly alignable with at least one of the closure indicator tabs when the lid is in a secured closed position on the container base.

These and other aspects of the present invention will be more apparent from the following description.

DETAILED DESCRIPTION

Figure 1:
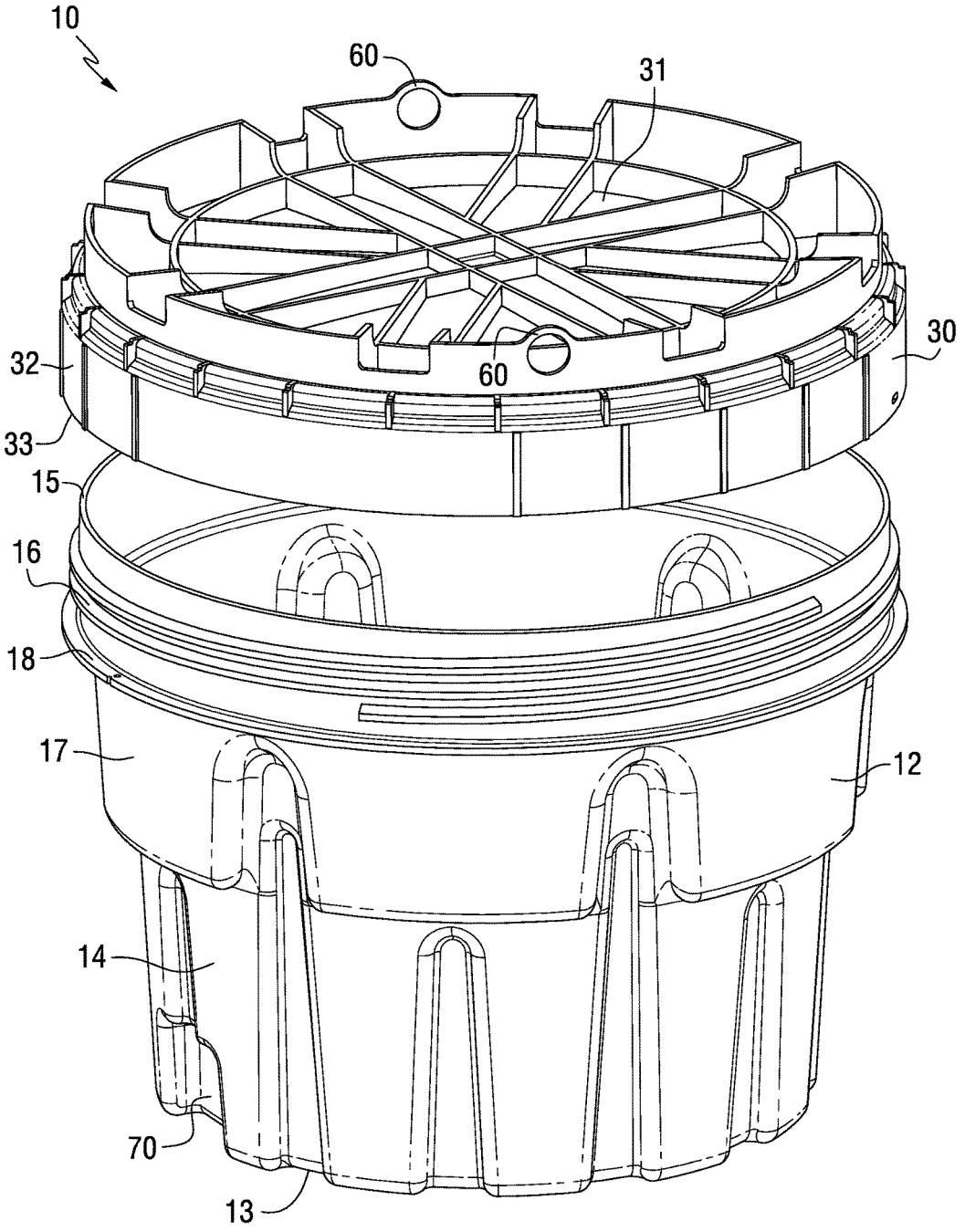
FIG. 1 is an exploded isometric view of a container base and lid of an overpack drum assembly in accordance with an embodiment of the present invention.

FIG. 1 illustrates an overpack drum assembly 10 in accordance with an embodiment of the present invention. As used herein, the term "overpack drum" means a container including a container base and a lid that may be securely closed on the container base. In certain embodiments, the overpack drums comprise overpack salvage drums that meet government regulations such as USDOT regulations. In other embodiments, the overpack drums may be used as part of spill kits to contain liquid spill response materials. The overpack drum assembly 10 includes a container base 12 having a bottom surface 13, sidewall 14 and upper opening 15. External threads 16 are provided near the top of the sidewall 14 below the upper opening 15. In the embodiment shown, the sidewall 14 includes an upper shoulder 17 having a diameter that is larger than the diameter of the lower portion of the sidewall. A radially extending rim 18 extends from the upper shoulder 17 below the external threads 16. The internal volume and dimensions of the container base 12 may be varied depending on the intended use of the overpack drum 10. For example, the capacity of each overpack drum may typically range from 5 gallons to 100 gallons or more. The outer diameter of each overpack drum 10 may typically range from 6 inches to 3 feet, e.g., from 10 to 25 inches. The overall height of each overpack drum may typically range from 6 inches to 4 feet, e.g., from 12 to 42 inches.

Figure 2:
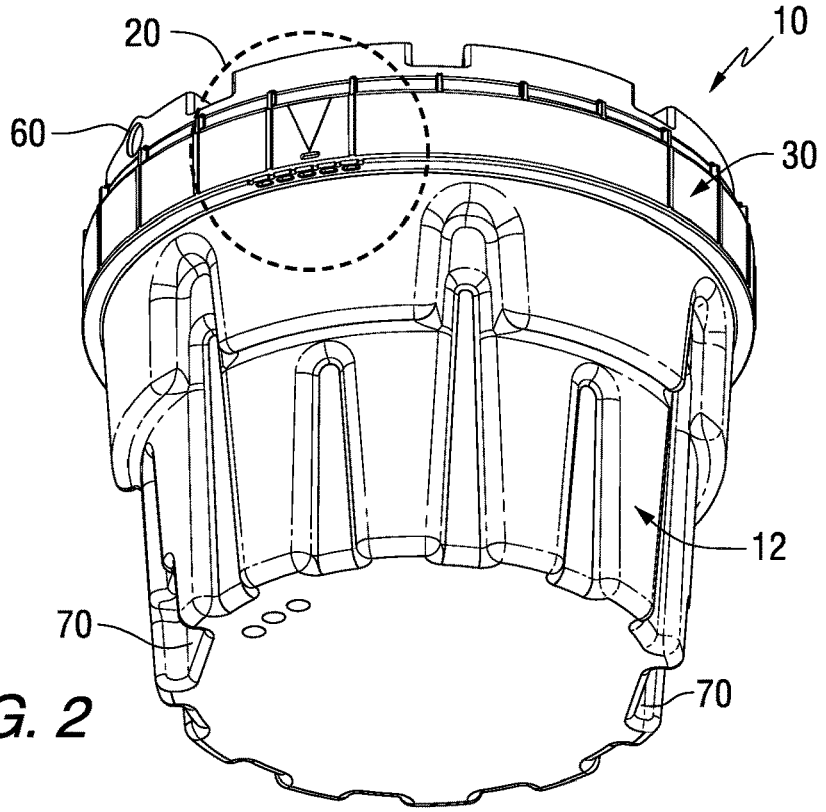
FIG. 2 is a bottom isometric view of the overpack drum assembly of FIG. 1.
Figure 3:
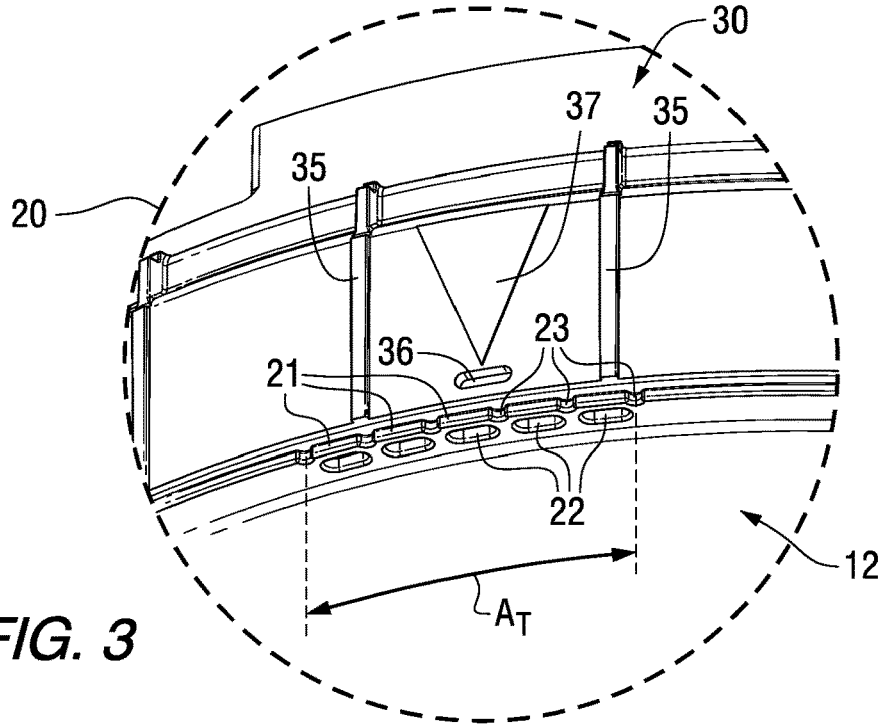
FIG. 3 is a magnified portion of FIG. 2 showing a closure indicating assembly in accordance with an embodiment of the present invention.

As shown in FIGS. 1-3, the overpack drum assembly 10 includes a lid 30 that may be removably secured to the container base 12. A closure indicating assembly 20 provides a closure zone indicator to ensure that the lid 30 is sufficiently tightened and secured to the container base 10 when the assembly is closed. As shown in FIGS. 2-5, the closure indicating assembly 20 includes indicator tabs 21 formed in the radially extending rim 18 of the container base 12. Each indicator tab 21 includes a hole 22 through which a security device 38 may pass, as more fully described below. Radially indented notches 23 are provided in the radially extending rim 18 circumferentially between adjacent indicator tabs 21. As shown in FIG. 3, the indicator tabs 21 have an arc length measured around a portion of the circumference of the radially extending rim 18, which is designated as the tab arc $A_T$. In the embodiment shown, the indicator tabs 21 are integrally formed with the radially extending rim 18, and the circumferentially spaced radially indented notches 23 define spaces between adjacent indicator tabs 21. However, any other suitable shape and arrangement of indicator tabs may be used, e.g., each indicator tab may extend radially outward from the outer diameter of the rim, and/or the indented notches may be of different shapes or may be eliminated. In the embodiment shown, there are five indicator tabs 21, but any other suitable number of indicator tabs may be used. For example, there may be two, three, four or more indicator tabs. In accordance with embodiments of the present invention, the multiple indicator tabs 21 are provided in order to allow for alignment of the lid 30 at different circumferential positions with respect to the container base 12 at which the lid 30 is sufficiently tightened and secured to the base 12, as more fully described below.

Figure 5:
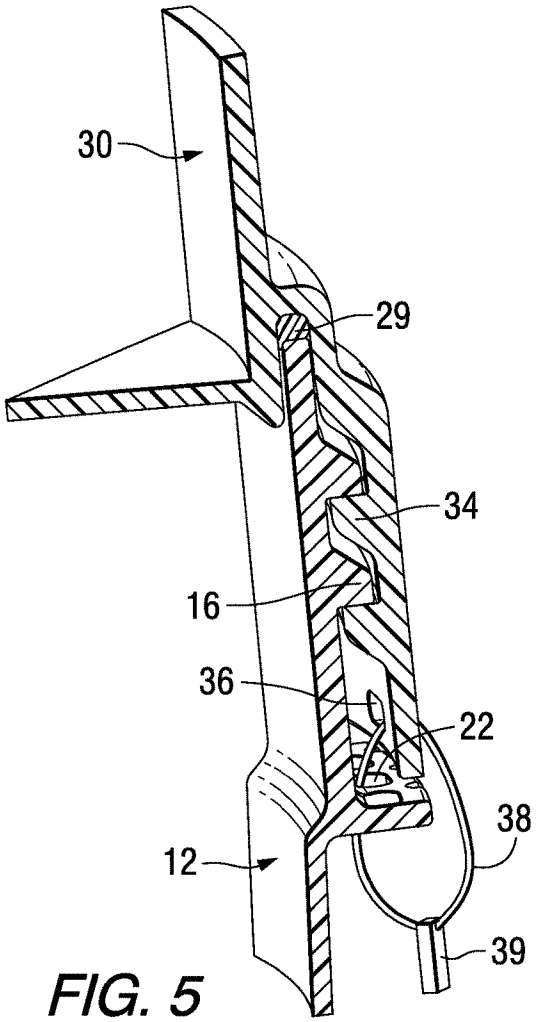
FIG. 5 is a broken away side sectional view showing a closure indicating assembly in accordance with an embodiment of the present invention.
Figure 4:
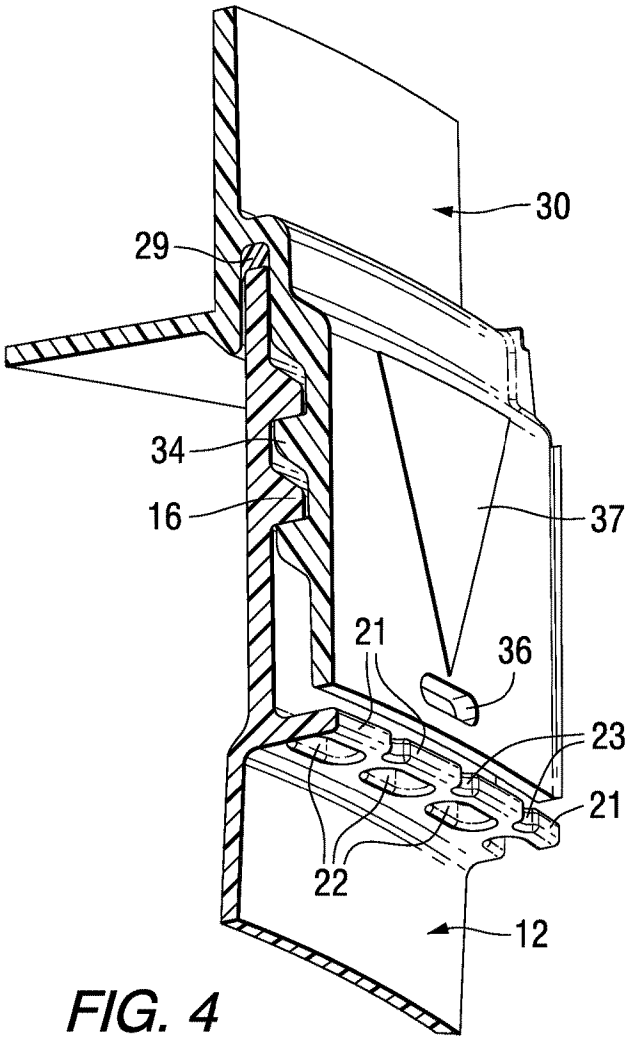
FIG. 4 is a broken away isometric sectional view.

As shown in FIGS. 1-5, the lid 30 includes a top surface 31, sidewall 32 and lower rim 33. Internal threads 34 are provided on the inside of the generally cylindrical sidewall 32 above the lower rim 33. Raised vertical ribs 35 may be provided on the exterior of the sidewall 32 in order to help strengthen the lid 30 and/or provide additional gripping surfaces when the lid 30 is opened or closed. A gasket 29 is seated in a channel of the lid 30, as shown in FIGS. 4 and 5. The gasket 29 may be made of any suitable type of compressible elastomeric material such as closed cell foam or other polymeric material. A closure security hole 36 is provided through the sidewall 32 of the lid 30. The closure security hole 36 is intended to be substantially aligned with one of the holes 22 of the indicator tabs 21 of the base 12 when the lid 30 is secured thereto. This arrangement provides an acceptable range of closure positions as long as the closure security hole 36 is aligned vertically above at least one of the tabs 21. As the lid 30 is tightened to its various closure positions, the gasket 29 is increasingly compressed to provide a seal between the lid 30 and the upper rim of the container base 12. In certain embodiments, the tab arc $A_T$, which represents the arc distance the tabbed region extends circumferentially around the rim 18, may range from 1° to 60°, for example, from 5° to 50° or from 10° to 40°. The use of multiple indicator tabs 21 and a closure security hole 36 in accordance with embodiments of the present invention provides for secure closure of the lid 30 at a desired position on the container base 12 without the necessity of additional mechanical fasteners such as clips or brackets fastened between the lid 30 and container base 12.

As shown in FIGS. 2-4, a closure alignment indicia 37 is provided on the sidewall 32 above the closure security hole 36 in order to provide a visual indication of whether the lid 30 is in a desired secured location with respect to the container base 12 when tightened thereon. Although the closure alignment indicia 37 shown in the figures comprises a downward facing triangular arrow, any other suitable indicia may be used, including other directional symbols, alphanumeric symbols, words, or the like.

When the lid 30 is sufficiently tightened on the container base 12 to a desired secure position, the closure security hole 36 and closure alignment indicia 37 may be substantially lined up with a corresponding indicator tab 21 and hole 22 of the container base 12. In this position, a security device 38 may be inserted through the closure security hole 36 and tab hole 22 in order to provide an indication of whether the lid 30 has subsequently been moved from its tightened secured position. In the embodiment shown, the security member 38 includes a wire loop with its ends secured together by a security tag 39. The wire security devices 38 and security tag 39 may provide a tamper-evident function in which any attempt to remove or significantly loosen the lid 30 from the container base 12 will result in breakage of the security tag 39, breakage of the security device 38 and/or removal of an end of the security device 38 from the security tag 39. Although the security device 38 shown in the FIG. 5 is provided in the form of a flexible wire, it is to be understood that any other suitable security device such as a strap, rod, cable or the like may be used. In addition, the security device may be provided in the form of a lock such as a combination lock or a key lock.

Figure 6:
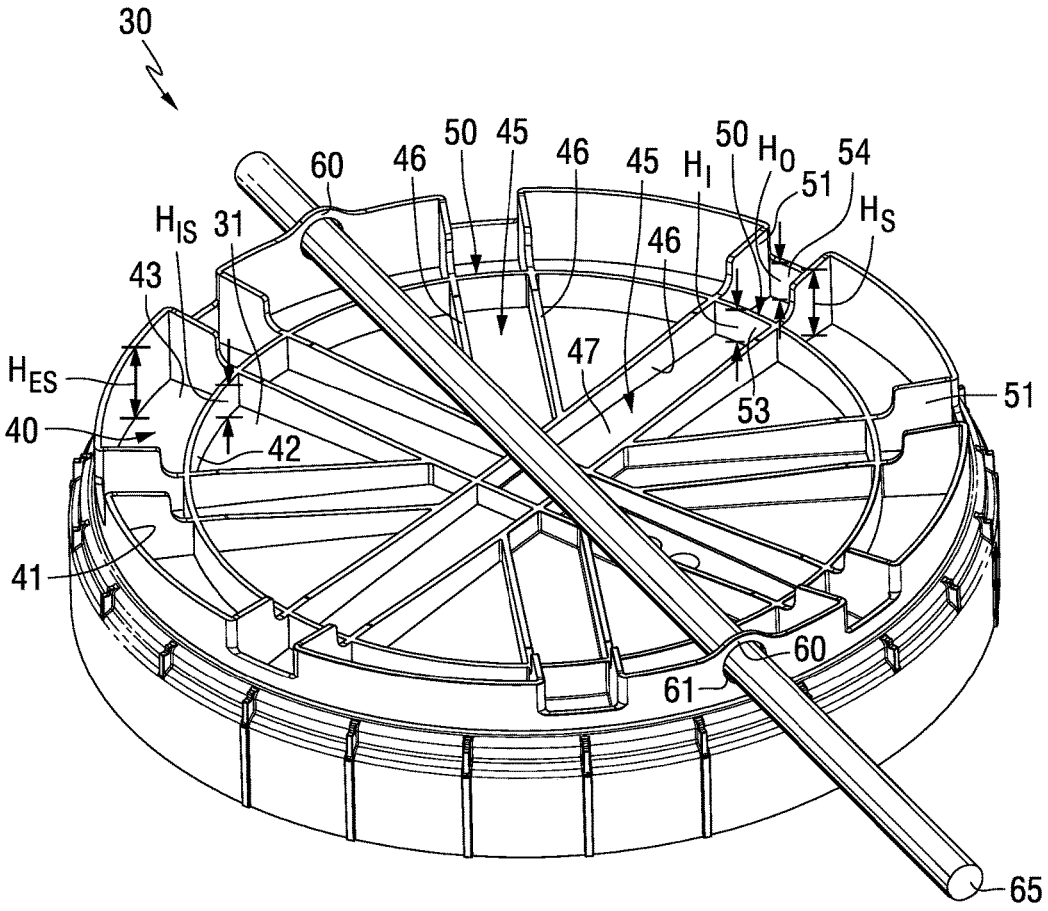
FIG. 6 is an isometric view of a lid of an overpack drum assembly in accordance with an embodiment of the present invention.

Additional features of the lid 30 are shown in FIG. 6. An annular channel 40 extends circumferentially around the upper surface of the lid 30 near the peripheral outer edge of the lid 30. The annular channel 40 includes an exterior cylindrical sidewall 41, an interior cylindrical sidewall 42 and a floor 43. In the embodiment shown, the floor 43 of the annular channel 40 lies in the same plane as the top surface 31 of the lid 30. As further shown in FIG. 6, multiple radial channels 45 are provided across the upper portion of the lid 30. Each radial channel 45 includes sidewalls 46 and a floor 47. In the embodiment shown, the floor 47 lies in the same plane as the top surface 31 of the lid 30.

As also shown in FIG. 6, multiple retaining channels 50 are provided around the circumference of the lid 30 in locations where the annular channel 40 intersects the radial channels 45. Each retaining channel 50 includes raised sidewalls 51, a radial inner wall 53, a radial outer wall 54 and a floor 52. In the embodiment shown, the floor 52 lies in the same plane as the top surface 31 of the lid 30. Each radial inner wall 53 corresponds to a portion of the interior cylindrical wall 42 of the annular channel 40. Each radial outer wall 54 corresponds to a portion of the exterior cylindrical sidewall 41 of the annular channel 40. However, the radial outer wall 54 of the retaining channel 50 is notched such that it does not extend the full axial distance of the exterior cylindrical sidewall 41 of the annular channel 40.

In accordance with certain embodiments, the various sidewall heights and other dimensions of the annular channel 40, radial channels 45 and radial retaining channels 50 are selected in order to allow a leverage bar (not shown), such as a wooden 2×4 stud or a metal bar or rod, to be positioned in a selected radial channel 45 in order to provide rotational leverage when closing or opening the lid 30. The exterior cylindrical sidewall 41 of the annular channel 40 has a height $H_{ES}$, and the interior cylindrical sidewall 42 has a height $H_S$. The exterior sidewall height $H_{ES}$ is greater than the interior sidewall height $H_{IS}$, e.g., at least 10 or 20 percent higher. For example, the ratio of $H_{ES}$:$H_{IS}$ may be from 1.2:1 to 5:1, for example, from 1.5:1 to 3:1. Each raised sidewall 51 of the radial retaining channels 50 has a height $H_S$, and each radial outer wall 54 has a height $H_O$. Each radial inner wall 53 has a height $H_I$. In the embodiment shown, the raised sidewall height $H_S$ is equal to the height $H_{ES}$ of the exterior cylindrical sidewall 41. Furthermore, in the embodiment shown, the height $H_I$ of the radial inner wall 53 is equal to the height $H_{IS}$ of the interior cylindrical sidewall 42. Similarly, the height $H_O$ of the radial outer wall 54 is equal to the height $H_{IS}$ of the interior cylindrical sidewall 42.

Figure 7:
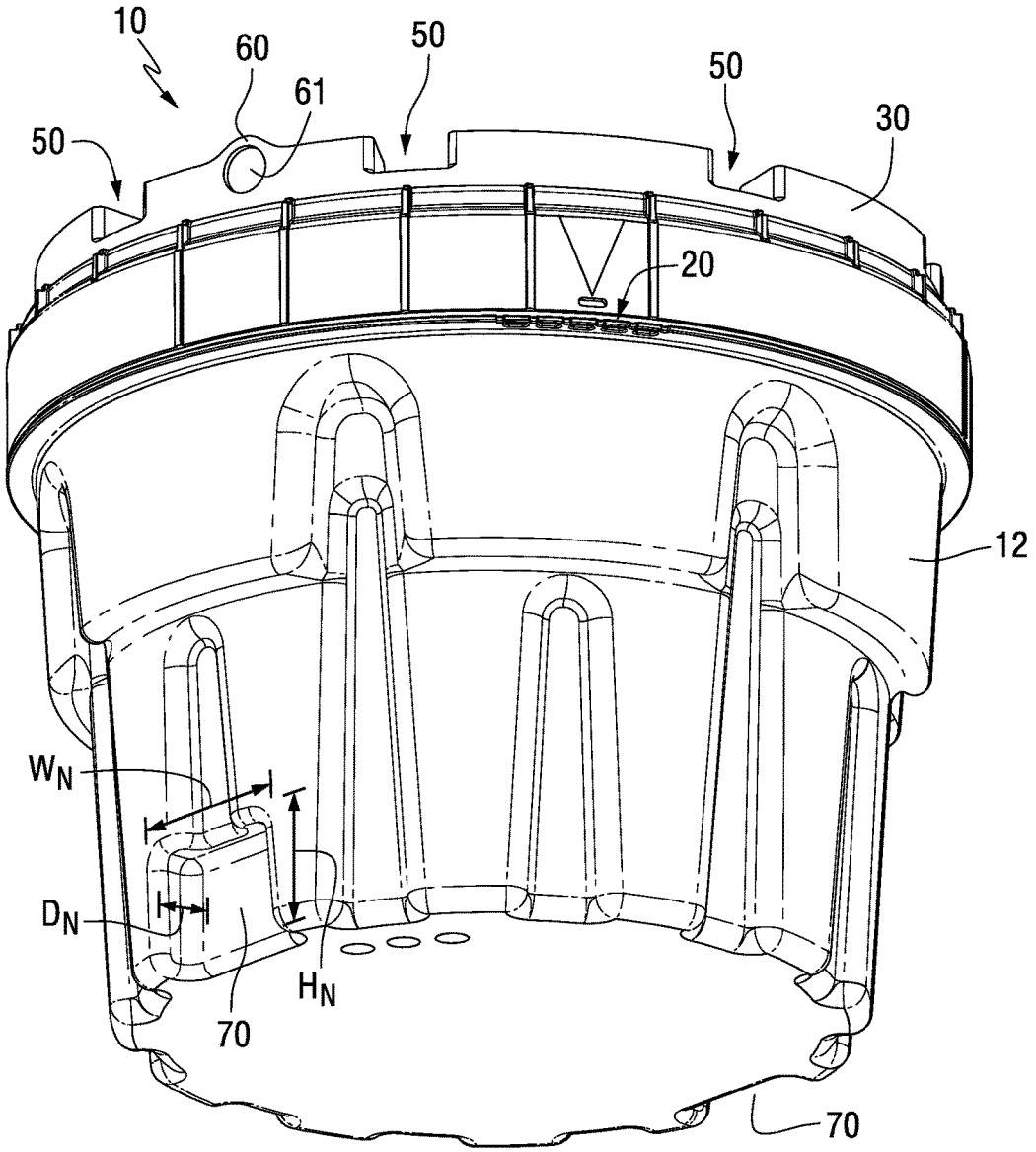
FIG. 7 is a bottom isometric view of an overpack drum assembly in accordance with an embodiment of the present invention.

In accordance with embodiments of the invention, the lid 30 may include leverage brackets 60, as most clearly shown in FIGS. 6 and 7. A leverage hole 61 is provided through each leverage bracket 60. A leverage bar 65 may be inserted through the leverage holes 61. The leverage holes 61 are fully or partially enclosed to prevent the leverage bar 65 from being removed in an upward direction from the holes 61, i.e., the leverage bar 65 must be inserted axially through the holes 61. In the embodiment shown, the leverage brackets 60 comprise an axial extension of the exterior cylindrical sidewall 41. Although the leverage holes 61 illustrated in the figures are provided in the form of fully enclosed circular openings, it is to be understood that non-enclosed or non-360° holes or notches may be used, e.g., a non-enclosed hole of greater than 220° or 270° to 360° may be provided through the exterior sidewall 41 of the annular channel 40.

As shown in FIG. 7, the container base 12 of the overpack drum assembly 10 may include at least one anti-rotation notch 70 extending radially inward a slight distance at the bottom surface 13 adjacent to the lower portion of the sidewall 14. Each anti-rotation notch 70 has a height $H_N$, width $W_N$ and depth $D_N$ selected to allow an operator to insert an object such as the toe portion of a boot or shoe into the notch 70 when the lid 30 is being tightened or loosened from the container base 12. For example, the radial depth $D_N$ of each anti-rotation notch 70 may range from 0.5 to 4 inches, or from 1 to 3 inches, or from 1.2 to 2 inches. As shown in FIG. 7, each anti-rotation notch 70 does not extend to the radial center of the bottom surface 13 of the container base 12. Such partial extension of the anti-rotation notches 70 minimizes the amount of volume that is lost from the interior of the container base 12, and maintains a flat support surface over most of the bottom surface 13. The height $H_N$ and width $W_N$ of each anti-rotation notch 70 are also selected to allow partial insertion of a user's boot or shoe, or another similarly sized object that may be used to prevent unwanted rotation of the container base 12. In certain embodiments, the notch height $H_N$ may be from about 2 to 4 inches, and the notch width $W_N$ may be from 3 to 5 inches. In the embodiment shown, two anti-rotation notches 70 are illustrated. However, any other suitable number of anti-rotation notches may be used, e.g., one, two, three, four, etc. Although the anti-rotation notches 70 shown in the figures have open bottoms, the bottom of each notch 70 may be closed, e.g., the bottom surface 13 of the container base 12 may extend under each notch 70 to form a pocket.

The anti-rotation notches 70 allow a single person to easily secure the lid 30 on the container base 12. When screwing lids on conventional large containers, the containers tend to spin and do not permit the lid to be secured tightly. This results in the need for a second person to secure the base container from rotating, which is still difficult without a tool to oppose container rotation. The anti-rotation notches 70 of the present invention provide depressions in the base container that allow for a foot or other means to be secured and oppose the rotation force created when the lid is screwed onto the base. The anti-rotation notches 70 also provide for the added possibility that one person can complete the lid closing task.

Figure 8:
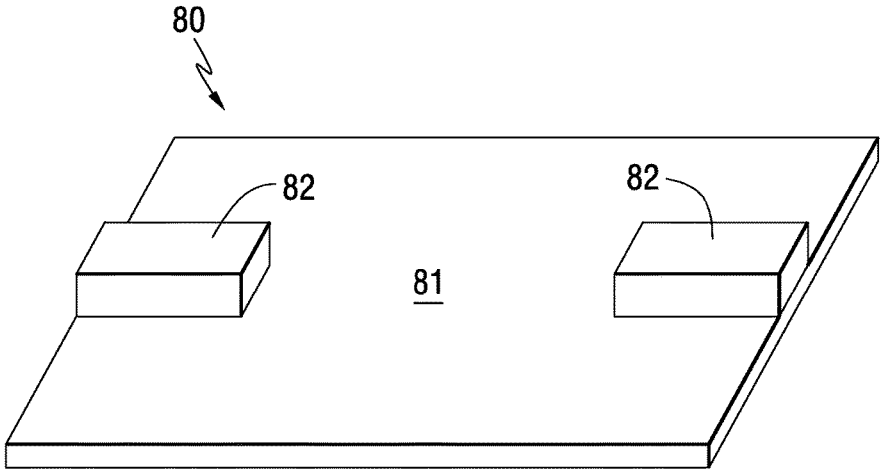
FIG. 8 is an isometric view of an anti-rotation fixture in accordance with an embodiment of the present invention.
Figure 9:
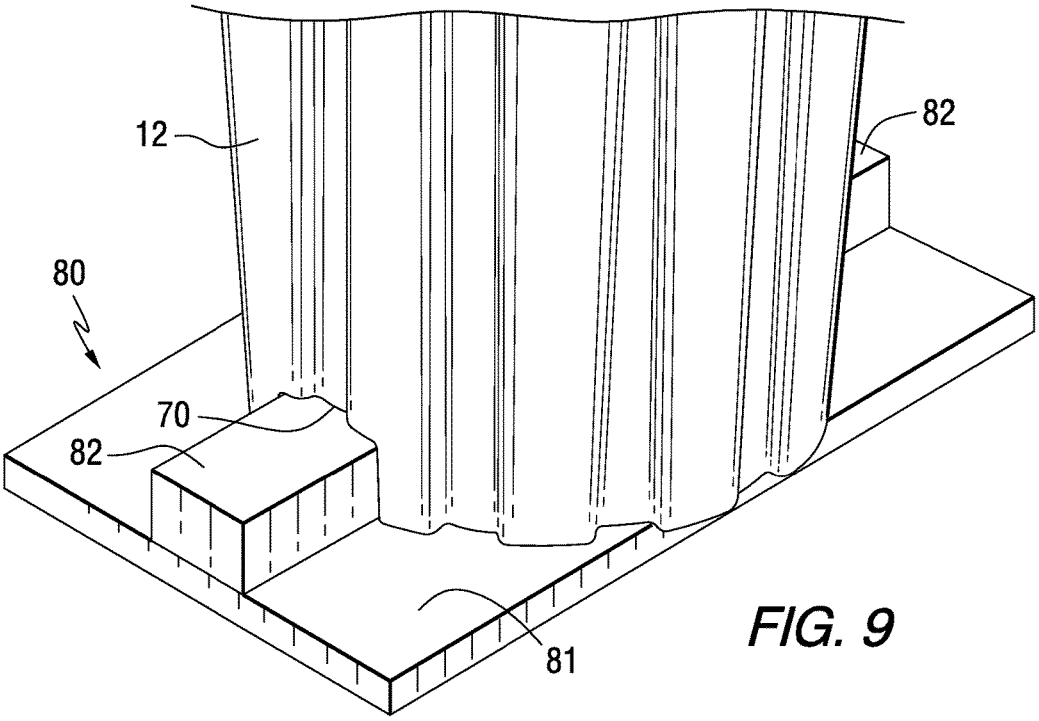
FIG. 9 is an isometric view of the anti-rotation fixture of FIG. 8 showing a portion of a container base placed thereon.

FIGS. 8 and 9 illustrate an anti-rotation fixture 80 in accordance with an embodiment of the present invention. The anti-rotation fixture 80 includes a base 81 with anti-rotation pegs 82 extending upwardly therefrom on two opposite sides of the base 81. The anti-rotation pegs 82 are sized to at least partially fit within the anti-rotation notches 70 of the container base 12, as shown in FIG. 9. For example, each anti-rotation peg 82 may have a height and width equal to, or slightly less than, the height $H_N$ and width $W_N$ of the anti-rotation notches 70. In the embodiment shown, the length of each anti-rotation peg 82 is greater than the depth $D_N$ of the anti-rotation notches 70, such that a portion of the anti-rotation peg 82 extends radially outward from the bottom of the container base 12 when placed on the fixture 80. Any suitable length of the anti-rotation peg 82 may be used, e.g., its length may be equal to the notch depth $D_N$ of the anti-rotation notches 70 or may be up to ten times or more greater than the notch depth $D_N$. Although the anti-rotation fixture base 81 shown in FIGS. 8-9 is rectangular with a width approximating the width of a container base 12 placed thereon, any other suitable shape and dimensions may be used. For example, the width of the base 81 may be smaller than shown in FIGS. 8 and 9, e.g., its width may be approximately the same as the widths of the anti-rotation pegs 82.

The container base 12 and lid 30 may be made of any suitable materials such as plastics, metals and the like. For example, the container base 12 and lid 30 may be made of polyethylene with UV inhibitors. The anti-rotation fixture 80 may be made of any suitable materials such as metal, wood, plastic and the like.

Whereas particular embodiments of this invention have been described above for purposes of illustration, it will be evident to those skilled in the art that numerous variations of the details of the present invention may be made without departing from the invention as defined in the appended claims.

What is claimed is:

1. An overpack drum lid comprising:

a generally circular top surface;

an upwardly open annular channel comprising a generally cylindrical exterior sidewall extending upward from the top surface circumferentially around an outer periphery of the lid, a generally cylindrical interior sidewall extending upward from the top surface radially inside the exterior sidewall, and a floor extending radially between the interior and exterior sidewalls forming a portion of the top surface;

a lower rim;

a generally cylindrical threaded sidewall extending between the top surface and the lower rim; and a pair of opposing leverage brackets circumferentially spaced from each other on the lid, wherein each leverage bracket comprises a fully enclosed leverage hole extending through the generally cylindrical exterior sidewall of the annular channel structured and arranged to receive a leverage bar therethrough.

2. The overpack drum lid of claim 1, wherein the fully enclosed leverage holes are circular.

3. An overpack drum assembly comprising:

a container base comprising an upper opening and a radially extending rim adjacent to the upper opening comprising a plurality of closure indicator tabs circumferentially spaced on a portion of the radially extending rim, wherein each of the closure indicator tabs comprises a hole extending vertically through the radially extending rim and tab; and a lid threadingly engageable with the container base comprising a closure security hole rotatingly alignable with one of the holes of the closure indicator tabs when the lid is in a secured closed position on the container base, wherein the closure security hole of the lid is alignable with another one of the holes of the closure indicator tabs when the lid is rotated in relation to the container base from the secured closed position, and wherein the lid further comprises:

a generally circular top surface; and an upwardly open annular channel comprising a generally cylindrical exterior sidewall extending upward front the top surface circumferentially around an outer periphery of the lid, a generally cylindrical interior sidewall extending upward from the top surface radially inside the exterior sidewall, and a floor extending radially between the interior and exterior sidewalls forming a portion of the top surface.

4. The overpack drum assembly of claim 3, wherein the closure indicator tabs are integrally formed in the radially extending rim.

5. The overpack drum assembly of claim 4, wherein the closure indicator tabs extend an arc distance $A_T$ around the circumference of the radially extending rim of from 5° to 50°.

6. The overpack drum assembly of claim 3, wherein the lid further comprises:

a lower rim;

a generally cylindrical threaded sidewall extending between the top surface and the lower rim; and a pair of opposing leverage brackets circumferentially spaced from each other on the lid extending upward from the top surface, wherein each leverage bracket comprises an at least partially enclosed leverage hole structured and arranged to receive a leverage bar therethrough.

7. The overpack drum assembly of claim 3, wherein the container base comprises:

a bottom surface;

an upper opening;

a generally cylindrical sidewall extending between the bottom surface and the upper opening; and at least one anti-rotation notch adjacent the bottom surface extending radially inward from the sidewall a distance less than a radius of the sidewall.

* * * * *